United States Patent [19]

Janson

[11] 4,102,008

[45] Jul. 25, 1978

[54] CURTAIN SUSPENSION ASSEMBLY

[76] Inventor: Richard W. Janson, Box 8110, Canton, Ohio 44711

[21] Appl. No.: 734,983

[22] Filed: Oct. 22, 1976

Related U.S. Application Data

[62] Division of Ser. No. 617,508, Sep. 29, 1975, Pat. No. 4,014,071.

[51] Int. Cl.[2] ..... A47H 1/04

[52] U.S. Cl. ..... 16/96 R; 16/95 R

[58] Field of Search ..... 16/87.4 R, 93 R, 93 D, 16/94 R, 94 D, 95 R, 95 D, 96 R, 96 D; 160/123, 126, 344, 345, 346, 347; 248/261, 262, 263, 265, 225.1; 211/123, 162; D8/377

[56] References Cited

U.S. PATENT DOCUMENTS

| | | | |
|---|---|---|---|
| 649,729 | 5/1900 | Isbills | 16/93 D |
| 1,605,258 | 11/1926 | Meiszner | 16/93 D |
| 2,597,224 | 5/1952 | Charron et al. | 16/87.6 |
| 2,727,272 | 12/1955 | Hankin et al. | 16/93 D |
| 3,152,354 | 10/1964 | Diack | 16/94 R |
| 3,346,227 | 10/1967 | Hankin | 248/224.1 |

FOREIGN PATENT DOCUMENTS

| | | | |
|---|---|---|---|
| 196,088 | 2/1958 | Austria | 16/96 D |
| 1,062,358 | 3/1967 | United Kingdom | 16/95 D |
| 1,393,890 | 5/1975 | United Kingdom | 160/345 |

*Primary Examiner*—Louis K. Rimrodt
*Attorney, Agent, or Firm*—Mason, Mason & Albright

[57] ABSTRACT

A curtain rod assembly manufactured primarily from extruded aluminum components, the curtain rod defining an elongated cruciform groove in its upper portion to receive therein a like shaped support part, a horizontal flange being provided at the rod's lower portion to receive wheeled curtain carriers, the rod being symmetrical about a vertical plane. In a modification of the rod, instead of a vertically elongated cruciform groove, a vertical plate-like portion is provided wherein such upper vertical portion is fastened through horizontal bolts to an overhead support, a flange on the lower aspect with a horizontal cross piece defining tracks for the wheeled curtain carriers as in the first modification, this second modification also being symmetrical about a vertical plane. A spacer support is provided for the first curtain rod having a pair of spaced parallel cruciform-shaped portions to be received in the like shaped slots of two overlapping parallel rods, the spacer including a stop member for carriers on one of the rods and a rope guide thereunder slideably to receive the curtain rope for supporting same. Live-end and deadend pulleys journalled in housings are provided which are adapted to support or be supported by a rod in a fixed relationship thereto so as to be aligned with the curtain carriers. The curtain rod is adapted to receive chain links in its cruciform slot for supporting the rod from the overhead structure at selected locations. The curtain rod also is adapted to be inverted whereby the flange, through a slot provided therein, is supported by overhead screw connections and a curtain carrier is received in the cruciform slot.

16 Claims, 22 Drawing Figures

CURTAIN SUSPENSION ASSEMBLY

This is a division of application Ser. No. 617,508, filed Sept. 29, 1975, now U.S. Pat. No. 4,014,071, issued Mar. 29, 1977.

BACKGROUND OF THE INVENTION

Many types and shapes of curtain suspension devices are available commercially and known in the prior art. These range from relatively modest devices such as found in homes and other living quarters to heavy duty suspension systems as found in theaters and those used in commercial establishments for large removable walls and doors. Examples of types of curtain suspension devices may be found in the patents to Hankin, U.S. Pat. No. 3,346,227 of Oct. 10, 1967, to Charron et al, U.S. Pat. No. 2,597,224, of May 20, 1972 and U.S. Des. Pat. No. 165,937 to Rosenbaum of Feb. 12, 1952. An increasing problem exists in the installation of curtain suspension assemblies — particularly the larger heavy-duty assemblages — in the labor costs of installing same. Thus as the curtain suspension systems become more complicated, time required for installation and the level of skill required increases. It has occurred to the inventor that this problem may be solved through designing the curtain suspension system at the plant as relatively simplified units which can be installed without the necessity of complicated or involved construction procedures and which at the same time are adaptable to a wide variety of architectural arrangements which may be encountered particularly in commercial and public establishments.

SUMMARY OF THE INVENTION

The invention relates to individual components of a curtain suspension assembly and to its components in various combinations. More particularly, the invention relates to such components, combinations and the assemblage thereof intended for heavy-duty use such as for the suspension of curtains in theaters and the like wherein the design and cooperation of the individual components facilitate its installation and the assemblage is thus easily installed and also adaptable to numerous overhead constructions which may be encountered.

Various components of the invention include a curtain rod which has flanges in its lower portion to receive curtain rod carriers and defines a cruciform-shaped groove of constant cross-section in its upper portion to receive a mating like shaped part of an overhead support or other component. The cruciform-shaped groove cooperates with an appropriately dimensioned link chain whereby the rod can be suspended from overhead structure without regard to the height of the structure and its location along the rod need not be specific to any feature of the curtain rod other than the longitudinal cruciform-shaped groove. Various supports which include the cruciform-shaped part for being received in the groove are adapted to cooperate with angle clips, gripping devices, bolts of various types and the like to provide considerable adaptability and flexibility in supporting and securing the curtain rod through the overhead structure at the installation site. Spacer dividers are included which automatically establish the amount of overlap at the mid portion of the curtain rods, provide a midway stop for the curtain rod carriers and further include a centrally located support for the rope which controls the curtains for opening and closing same. Live-end and deadend pulley housings with pulleys installed are further provided which may either be suspended from the cruciform-shaped groove of the curtain rod or from the lower flange thereof and secured so as not to be movable longitudinally relative to the curtain rod whereby they are automatically located in a desired position relative to the rest of the assemblage. A novel adaptability of the curtain rod in accordance with the invention is its capacity to be inverted and used as a curtain rod for lesser sized installations wherein carriers for the curtain are received within the cruciform-shaped groove with their curtain hooks depending therefrom. In a modification of the curtain rod for structures wherein the rod will be secured so as to lie transverse under and relative to a plurality of spaced overhead beams of the same height, the structure of the rod which defines the cruciform-shaped groove may be replaced by a vertical coplanar part which is fastened to the overhead by means of a plurality of angle clips.

From the foregoing, it should be understood by those skilled in the art that a primary object of the instant invention is the provision for a heavy duty adaptable and yet simplified curtain suspension system which is constituted of individual elements, such elements being preferably manufactured of extruded aluminum or other extruded material. However, other objects of adaptabilities and capabilities of the invention will be appreciated by those skilled in the art as the description progresses, reference being had to the accompanying drawings in which:

DESCRIPTION OF THE PREFERRED EMBODIMENTS

Figure 1:
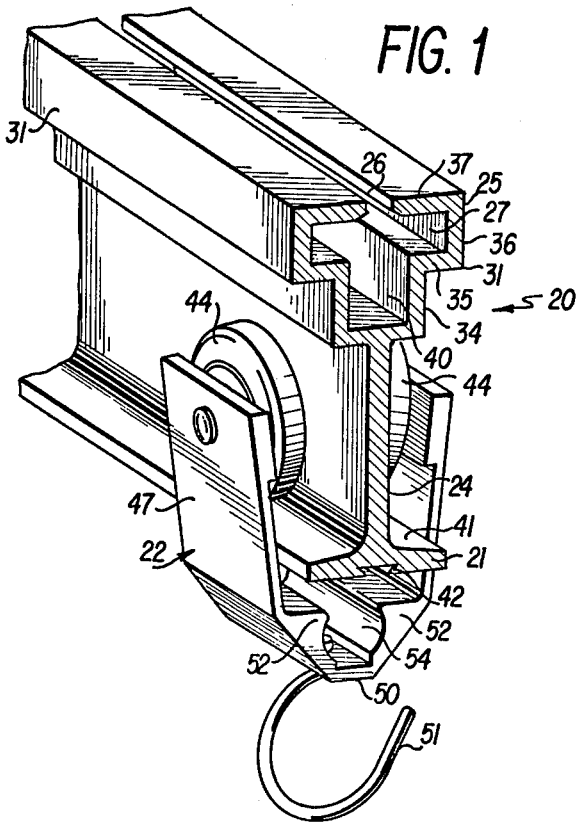
FIG. 1 is a perspective view of a first embodiment of the invention showing the curtain rod and a curtain carrier thereon.

The assembly of the invention which is intended for heavy duty use, comprises, as shown in FIG. 1, a curtain track or rod 20 which supports on its lower flange 21 a plurality of curtain carriers such as carrier 22. Rod 20 comprises a vertical part 24 which extends upwardly normally from flange 21 to the upper portion 25 which defines a slot 26 in groove 27 for receiving a rod support 30 as shown, for example, in FIG. 5. Upper portion 25 comprises a pair of arms 31 which, as seen in cross-section are mirror images, one of the other, each including first a horizontal extension 32, next a second vertical extension 34, then a third further horizontal extension 35, and next a fourth further vertical extension 36, each arm 31 then extending inwardly to define slot 26, thus terminating with a fifth still further horizontal extension 37. Arms 31 define a cruciform-shaped space as seen in cross-section which comprises upper slot 26, grooves 27 on either side and a lower recess 40 between vertical part 24 and slot 26. In the lower portion 41 of rod 20, flange 21 may be provided with a bottom groove 42 which is broader in its upper inner aspect than at its lower aspect.

Figure 1A:
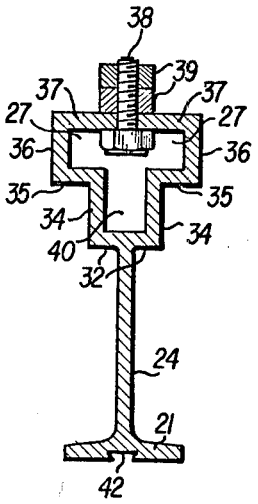
FIG. 1A illustrates the incorporation of limiting means in the curtain rod.

Referring to FIG. 1A, a stop or limiting means is provided which comprises a bolt 38 which has its head within the grooves 27 and its threaded shank extends upwardly through slot 26 wherein it is threadably received by a pair of nuts 39.

Figure 1B:
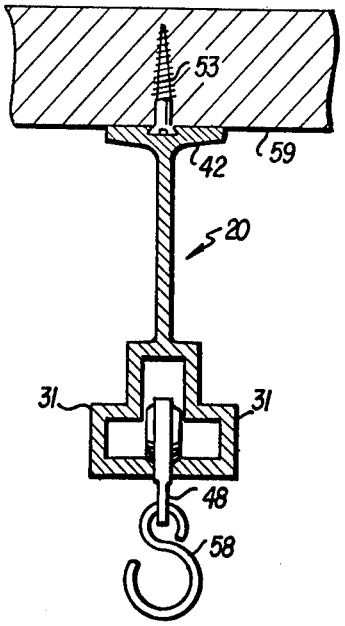
FIG. 1B shows the curtain rod in accordance with the invention in an inverted mode.

As shown in FIG. 1B, by inverting rod 20, it may be utilized for a less expensive curtain track for a lighter curtain or drapes wherein the space defined by arms 31 receives a plurality of movable supporting members 48 which are each provided with a depending hanger portion 58, such supporting member 48 conforming to a structural device disclosed in U.S. Pat. No. 3,076,222 to P. H. Sloan of Feb. 5, 1973. The recess 42 is utilized to support rod 20 by a plurality of flat head screws 53 received and aligned in a ceiling member 59.

Figure 3:
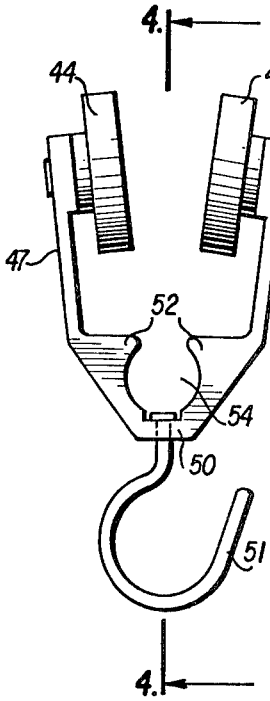
FIG. 3 is an elevational detail view of the carrier shown in FIG. 1.
Figure 4:
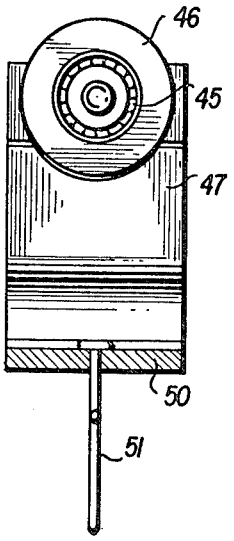
FIG. 4 is a sectional view of the carrier shown in FIG. 3 on section lines 3—3 of such Figure.
Figure 18:
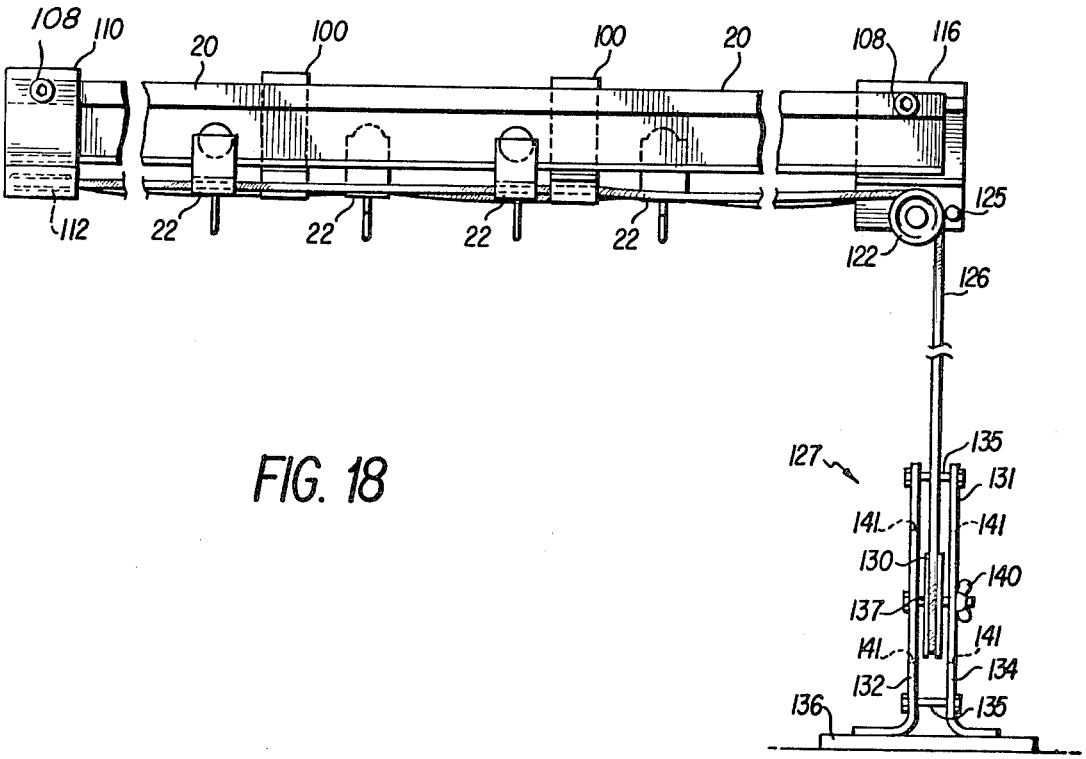
FIG. 18 is an elevational broken view which illustrates cooperation of various components of the curtain suspension assembly of the invention.

Curtain carriers 22 as shown in FIGS. 1, 3 and 4 incorporate two wheels 44, each such wheel having a race of ball bearings 45 and equipped with rubber or neoprene tires 46 for silent operation. Each wheel 44 is journalled to an arm member 47. The lower part of each arm member 47 joins and is integral with a horizontal member 50 which carries a depending curtain hook 51. Each arm member 47 also includes a thicker profiled part 52 which defines a horizontal cylindrical opening 54 for frictionally receiving the curtain rope 126 (FIG. 18).

Figure 5:
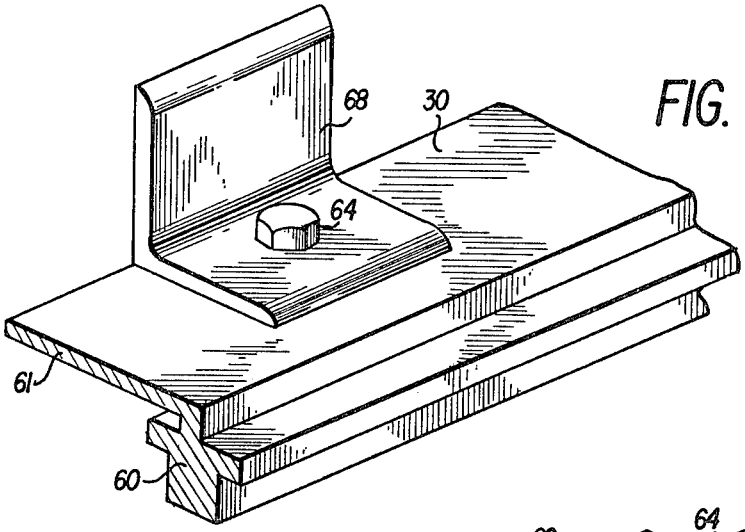
FIG. 5 is a perspective view of a rod support bolted to an angle clip.
Figure 6:
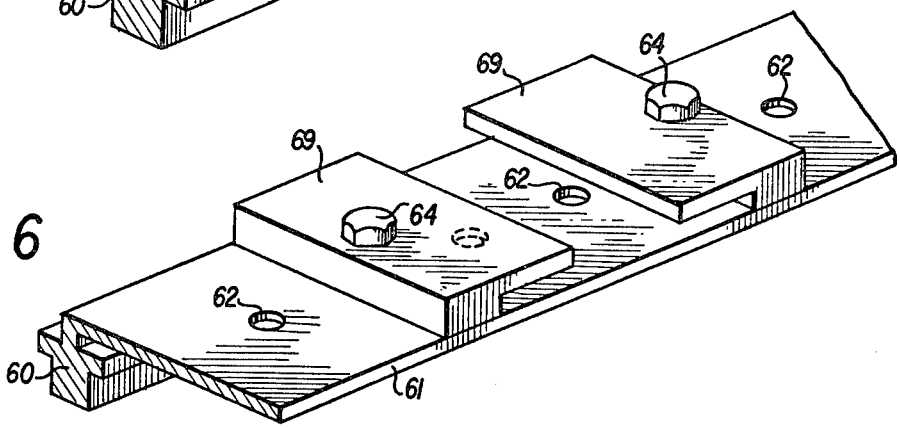
FIG. 6 is a perspective view of a rod support with cross-beam clamps bolted thereto.
Figure 8:
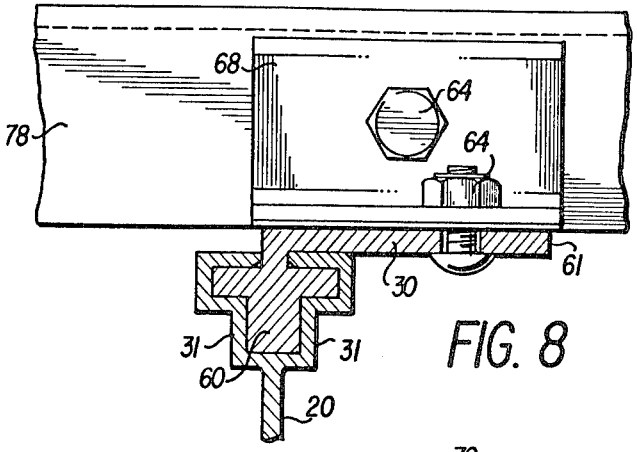
FIG. 8 is a broken view illustrating an angle clip similar to that shown in FIG. 5 together with the rod support and curtain rod.

Each rod support 30, as seen in FIGS. 5 and 8 includes a support part 60 of cruciform-shaped cross-section so as to mate with and be received slideably within the cruciform-shaped space defined by arms 31 of rod 20. Rod support 30 also comprises a horizontal flange member 61 extending in one direction from the top of part 60 and integral therewith. As illustrated in FIG. 6, flange member 61 may be provided with one or more openings 62 to receive bolts 64 or the like whereby support 30 may be connected to the lower flanges of I-beams of various sizes by cross-beam clamps 69 or via angle clip 68, to an overhead beam 78 as shown in FIG. 8.

Figure 2:
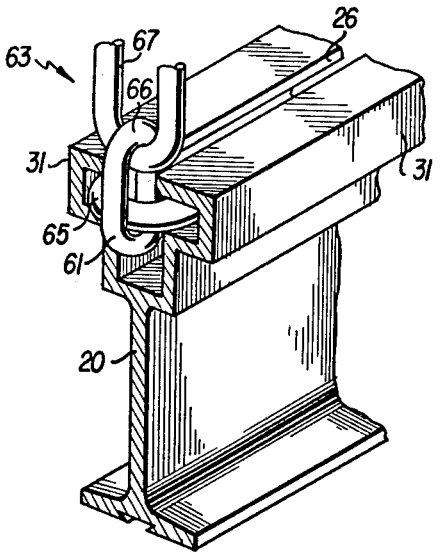
FIG. 2 is a perspective view of the curtain rod shown in FIG. 1 suspended by a link chain.
Figure 7:
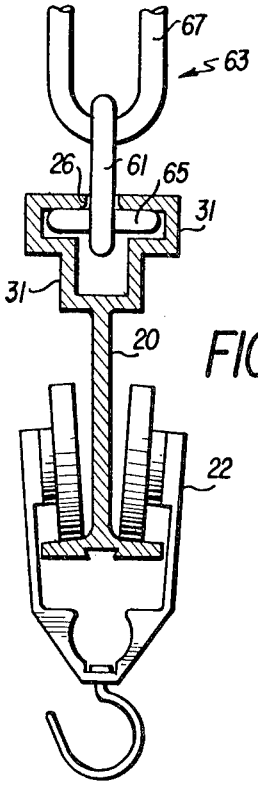
FIG. 7 is an elevational view showing a curtain rod supported by a link chain with a carrier.

With particular reference to FIGS. 2 and 7, a link chain 63 may be provided at any point along rod 20 and without the necessity of utilizing drills or other tools or bolts. This is accomplished by inserting the bottom or lower link 65 into the cruciform-shaped spaced defined by arms 31 with the next to last link 66 extending through the slot 26 in a vertical disposition. The next higher link 67 and other links also hang vertically. Accordingly, with an appropriate dimensioned link chain 63, rod 20 may be supported by such link chain without the necessity of drilling holes or using nuts and bolts. Moreover, the link chain 63 may be slipped along the slot 26 until under an overhead beam or other structured member to which chain 63 may be attached to support the curtain rod 20 at the desired height.

Figure 9:
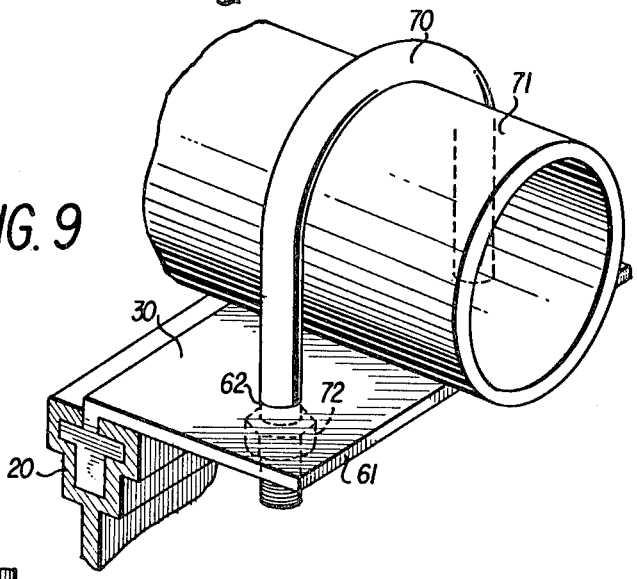
FIG. 9 is a perspective view illustrating a rod support as shown in FIG. 5 connected to an overhead pipe.

FIG. 9 illustrates a rod 20 supported by a rod support 30 which in turn has its flange member 61 connected to a pipe 71 by means of a U-bolt 70 received through a pair of openings 62 with lower threaded portions of U-bolt 70 receiving a pair of nuts 72 (only one shown). The extrusion which constitutes support 30 and flange member 61 may be severed at an angle other than 90° relative to rod 20.

Figure 10:
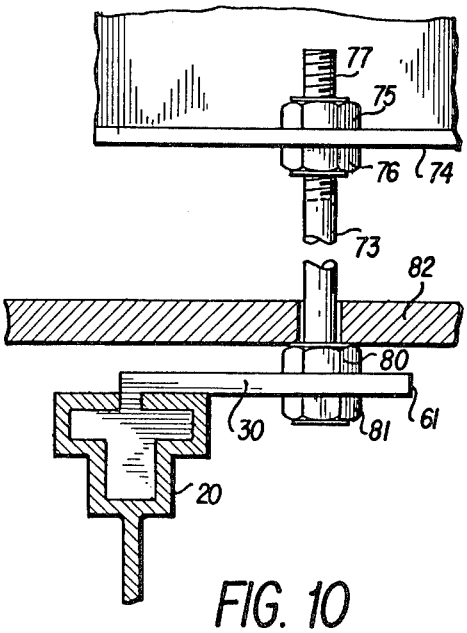
FIG. 10 is an elevational view illustrating means to suspend a rod support as shown in FIG. 5 under a suspended ceiling.

In FIG. 10, means for attaching the rod support 30 to a suspended ceiling 82 is disclosed. Here a bolt 73 is secured directly to an overhead bottom flange 74 of a steel roof member by nuts 75 and 76 received on the threaded end portion 77 of bolt 73. Flange member 61 receives the lower end of bolt 73 through an opening 62 and is secured thereto by means of nuts 80 and 81 in a manner whereby nut 80 performs the further function of contributing to the support of the suspended ceiling 82. Through this arrangement hangers or bolts 73 position rod support 30 immediately below the suspended ceiling 82.

Figure 11:
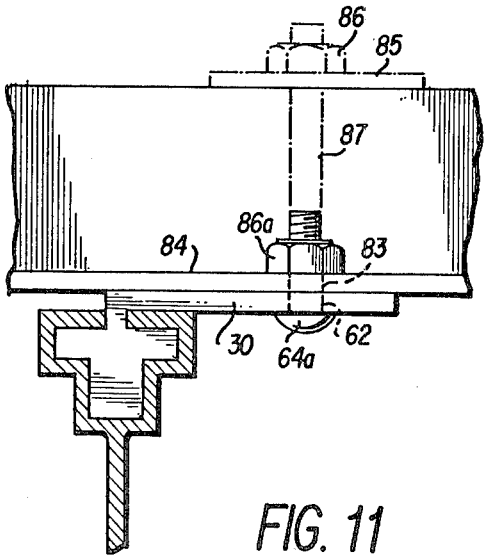
FIG. 11 is an elevational view illustrating connection of a rod support shown in FIG. 5 to the bottom chord of joists.

In FIG. 11, rod support 30 is fastened directly to the bottom of an exposed steel flange 84 or, if the bottom chord of the joist comprises angles situated back-to-back with a space between, longer bolts 87 as indicated in dot-dash lines are used with a heavy washer 85 to bridge such joists which are situated back-to-back, the heavy washer 85 held in place by means of a nut 86. In fastening rod support 30 directly to the bottom of steel flange 84, a short threaded bolt 64*a* is employed through the opening 62 and a further opening 83 in flange 84. A nut 86*a* is received by bolt 64*a* as shown in FIG. 11.

Figure 12:
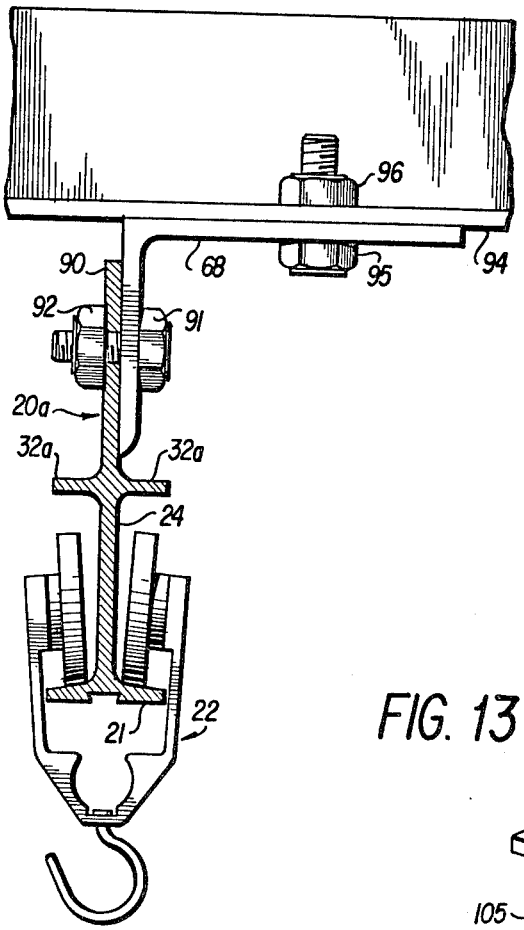
FIG. 12 is an elevational view of a modified curtain rod with a carrier thereon which is connected directly by means of an angle clip to the bottom chord of an overhead joist.

In FIG. 12 a modified rod 20*a* is shown which is similar to rod 20 in that it includes a vertical part 24 and a lower flange 21 which supports curtain carriers 22. It also includes a pair of oppositely extending horizontal extensions 32*a*, but instead of having arms 31, a single vertical plate part 90 is provided which is bolted to an angle clip 68 and by means of bolt 91 and nut 92 as shown in FIG. 12. Angle clip 68, in turn, is bolted to the bottom flange of an overhead I-beam 94 by means of bolt 95 and nut 96.

Figure 13:
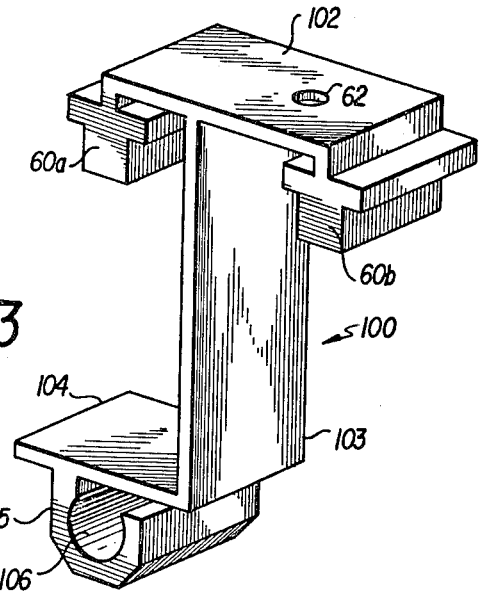
FIG. 13 is a perspective view of a combination lapping spacer, rod support, carrier bumper and rope holder.
Figure 14:
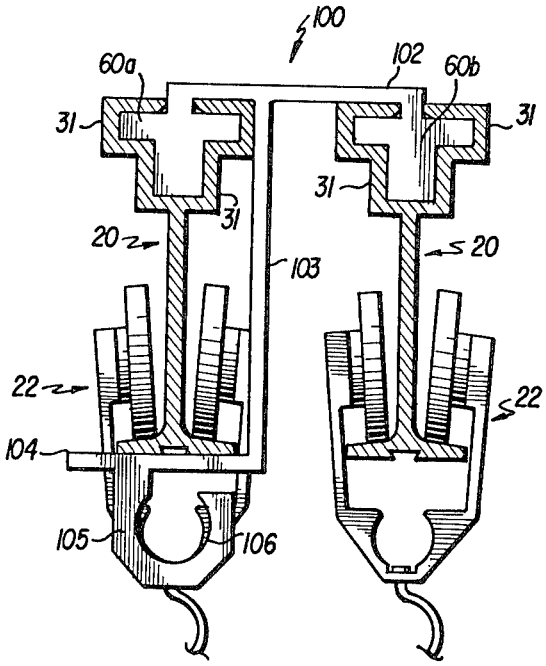
FIG. 14 is an elevational view of the spacer shown in FIG. 13 supporting a pair of curtain rods with a carrier shown on each.

In FIGS. 13 and 14, a lapping spacer designated generally by reference 100 is illustrated. Spacer 100 performs the different functions of being a lapping spacer for overlapping rods at the midway curtain overlap, a carrier for such rods and a rope holder or support for the rope utilized for moving the curtains and located at the mid lap of overlapping curtains or drapery. In this connection it will be understood that normally two curtain rods 20 are provided which are separated to permit the two curtain sections to overlap in the central location of the area served by the curtains. The spacing function of the spacer 100 is served by the upper part which comprises a flat plate portion 102 with depending cruciform-shaped support parts 60*a* and 60*b* at the edges thereof, such parts 60*a* and 60*b* being so configured to be slideably received in the space comprising slot 26, grooves 27 and recess 40 of curtain rod 20 and in this sense identical to part 60. Extending downwardly from plate portion 102 between support parts 60*a* and 60*b* is a bumper part 103 which includes a horizontal leg 104. A rope guide 105 extends downwardly from leg 104 to hook around and partly surround a cylindrically-shaped horizontally disposed guide space 106 which receives the rope in a slideable fashion for moving the curtains and provides support for same. Leg 104, together with guide 105 performs the bumper function of spacer 100 and rope guide 105 functions to support rope for moving the curtains approximately at the upper central part thereof. Thus the rope is supported at about the middle of the complete track to minimize its sagging.

Figure 15:
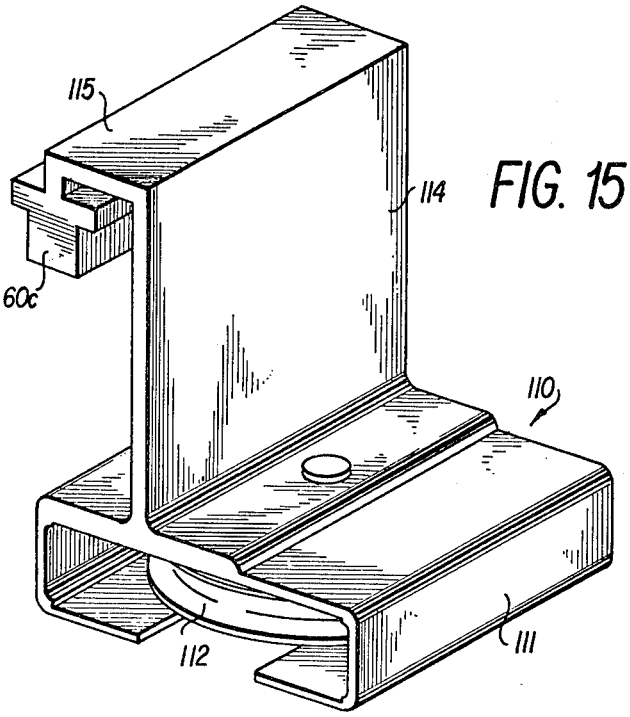
FIG. 15 is a perspective view of a combination deadend pulley and rod supports.
Figure 16:
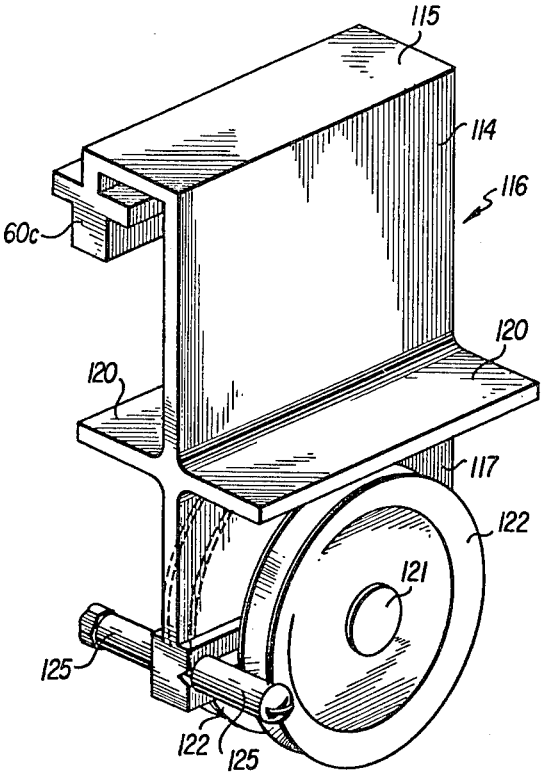
FIG. 16 is a perspective view of a combination live-end pulley and rod support.

In FIG. 15, a single end pulley also known as a deadend pulley member 110 is shown which comprises a housing 111 which carries the pulley 112 and has extending upwardly therefrom a vertical plate 114 which integrally connects to a horizontal plate 115. Depending from the plate 115 is a cruciform-shaped member 60*c* which, identical to parts 60, 60*a* and 60*b*, is configured to be received by the space defined by slot 26, grooves 27 and recess 40 of curtain rod 20. By then affixing part 60*c* relative to rod 20 by a bolt 38 or set screw 108 (See FIG. 18), pulley 112 is automatically aligned in its desired location relative to rods 20 and carriers 22 for overlapping curtains carried by carriers 22. The same is true with reference to the double end pulley known as a live-end pulley member 116 shown in FIG. 16. It will be understood that the live-end pulley member 116 includes a bracket 117, a cover plate 120 and, identical to the dead end pulley member 110, a vertical plate 114, horizontal plate 115 and support part 60*c*. An axle 121 rotatably carries a pair of pulleys 122 which are secured relative to vertical plate 114 by a nut (not shown). A pair of rotatable keepers 125 are also bolted to the bracket 117 which serve the purpose of maintaining rope 126 within the pulleys 122.

Figure 15A:
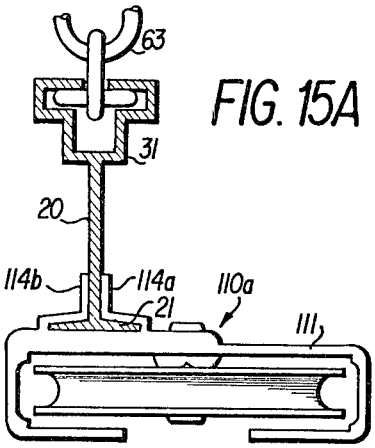
FIG. 15A is an elevational view of a rod supported deadend pulley.

FIG. 15A shows in elevational view an alternative embodiment of a deadend pulley member which is designated 110*a*. Here it will be noted that housing 111 is provided with a pair of upstanding profiled plates 114*a* and 114*b* which receive flange 21 of rod 20 which in turn is supported by link chain 63 received in the space defined by arms 31 as previously explained.

Figure 16A:
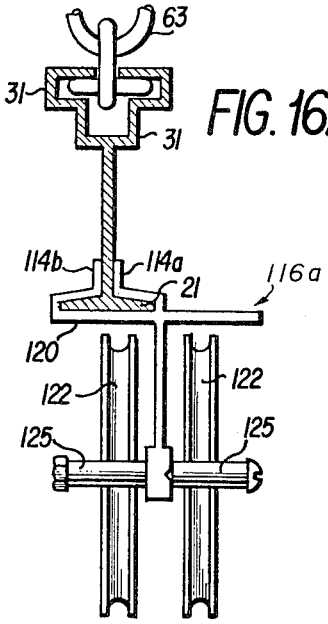
FIG. 16A is an elevational view of a rod supported live-end pulley.

In the embodiment of FIG. 16A of a modified live-end pulley, similar profiled plates 114*a* and 114*b* are provided so as to be connected to and integral with cover part 120 which, as shown in FIG. 16A, are configured to receive flange 21 of rod 20 which, in turn, is supported by link chain 63 received in a space between arms 31 as previously explained and shown in more detail in FIG. 2. Again, either pulley member 110*a* or 116*a* as shown in FIGS. 15A and 16A may be affixed to a rod 20 by means of a set screw, bolt or other suitable means. Also, again, each pulley device is automatically located relative to rod 20 and carrier 22 through the arrangement disclosed.

Figure 17:
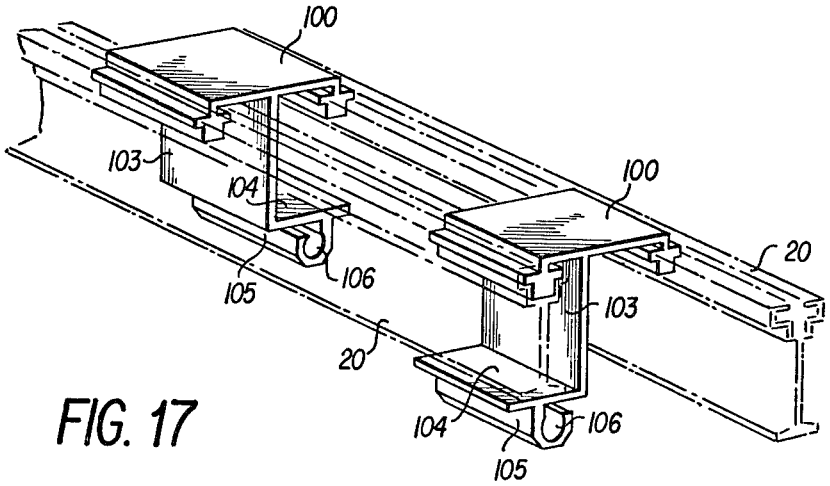
FIG. 17 is a perspective view illustrating the utilization of a pair of lapping spacers as shown in FIGS. 13 and 14 within the curtain suspension system.

FIGS. 17 and 18 disclose the assembly whereby the cooperation of various components may be more readily understood. In FIG. 17, the disposition of a pair of spacers 100 relative to overlapping rods 20 (shown in dot-dash lines) at the midway curtain overlap is shown.

In FIG. 18, the entire assembly is shown including the endless rope 126 and a floor pulley member 127 which includes a pulley 130 held in a housing 131 comprised of a pair of spaced plates 132 and 134 held in alignment by spacing bolts 135, plates 132 and 134 being affixed to a bottom plate 136 which is secured to the deck. Pulley 130 is supported by an axle 137 which is held in its desired vertical disposition by a wing nut 140 within vertically disposed slots 141 whereby the height of the pulley 130 is vertically adjustable relative to the housing 131.

Referring to FIGS. 17 and 18, it will be noted that a pair of overlapping rods 20 are in part supported and held the desired distance apart by means of spacers 100 which also function to prevent carriers 22 from moving off of the respective rods 20. A rope 126 for opening and closing the curtain carried by carriers 22 is received in an endless manner about the pulley 112 into space 54 of each carrier 22 wherein it is frictionally received and secured and causes the carriers 22 therefore to move with it. Rope 126 extends through guide space 106 in rope guide 105 through which it easily slides, to the live-end pulley 122 and finally to and around the floor pulley 130. Thus by causing rope 126 to be moved to one direction or the other, carriers 22 together with curtains suspended therefrom are caused to move so that the curtain is either opened or closed and, upon closing, overlaps a distance as defined longitudinally between the spacers 100.

The components of the assembly such as rods 20 and 20*a*, rod supports 30, angle clip 68, I-beam clamps 69, spacers 100, pulley members 110, 110*a*, 116 and 116*a*, are, insofar as practicable, extruded aluminum. The drawings are approximately proportional to the actual components used. As a measure of comparison, rod 20 is about 6.6 cm in height and 3.5 cm in width across arm 31 and 3.0 cm across flange 21. Size is important to cost of manufacture as well as to strength and weight of the components.

Although the preferred embodiments of the invention are described above, it is to be understood that the invention includes other adaptations and modifications within the scope of the appended claims which should be construed to cover corresponding structure described in this specification and equivalents thereof.

Having thus described my invention, what I claim as new and desire to secure by Letters Patent of the United States is:

1. A traverse rod for supporting curtains and the like, the rod comprising an extruded material with a uniform cross-section throughout its length and comprising an upper rod portion which comprises two spaced apart arms which define between them a groove for slideably receiving supporting structure for the rod, the upper ends of said arms defining a slot giving said supporting structure access centrally into said groove, and a lower curtain or the like carrier supporting portion extending downwardly from said upper portion, said lower portion including flange means adapted to receive curtain or the like carriers for horizontal movement therealong, stop means for limiting movement of said rod supporting structure received in said groove, said stop means comprising a bolt received through said slot rigidly connected only to said arms, said bolt included in a portion in said groove.

2. A traverse rod in accordance with claim 1 wherein said bolt portion in said groove comprises a bolt head.

3. A traverse rod in accordance with claim 2 wherein at least two nuts are secured to the portion of said bolt extending upwardly out of said groove through said slot.

4. A traverse rod in accordance with claim 1 wherein said groove is of a cruciform configuration.

5. A traverse rod in accordance with claim 1 wherein the rod is composed of aluminum.

6. A traverse rod in accordance with claim 1 wherein the rod is symmetrical about a vertical plane containing the rods longitudinal axis.

7. A traverse rod for supporting curtains and the like which comprises: An upper rod support portion which comprises two spaced apart arms which define between them a groove, said groove having a vertical cross-section configuration substantially of an upright "T", the upper ends of said arms defining a slot giving access centrally into said groove for receipt therein of supporting structure for the rod; a lower curtain or the like carrier supporting portion extending downwardly from said upper portion, said lower portion being substantially of an inverted "T" shape in cross section and comprising a central vertically disposed part and a lower horizontal flange centrally joining the lower aspect of said vertically disposed part, the upper surfaces of said flange on both sides of said vertically disposed part adapted to receive curtain or the like carriers for horizontal movement therealong, the upper aspect of said vertically disposed part joining with said arms and being substantially centered under said slot whereby a vertical plane containing said vertically disposed part passes through said slot; and stop means for limiting movement of structure received in said groove being provided, said stop means comprising a bolt received through said slot rigidly connected only to said arms, said bolt including a portion in said groove.

8. A traverse rod for supporting curtains and the like in combination with supporting structure which includes a depending vertical part and a horizontal part connected thereto and spaced above the bottom of said vertical part, said rod comprising: an upper rod support portion which comprises two spaced apart arms which define between them a groove, said groove having a vertical cross-section configuration substantially of an upright "T", the upper ends of said arms defining a slot giving access centrally into said groove for receipt thereof of said vertical part of said supporting structure for the rod, the bottom of said vertical part received in the vertical portion of said "T-shaped" groove, and said horizontal part received in the horizontal portion of said "T-shaped" groove; a lower curtain or the like carrier supporting portion depending downwardly from said upper portion, said lower portion being substantially of an inverted "T" shape in cross-section and comprising a central vertically disposed part and a lower horizontal flange centrally joining the lower aspect of said vertically disposed part, the upper surfaces of said flange on both sides of said vertically disposed part adapted to receive curtain or the like carriers for horizontal movement therealong, the upper aspect of said vertically disposed part joining with said arms and being substantially centered under said slot whereby a vertical plane containing said vertically disposed part passes through said slot; and stop means for limiting movement of said supporting structure received in said groove, said stop means comprising a bolt received through said slot rigidly connected only to said arms, said bolt including a portion in said groove.

9. A traverse rod for supporting curtains and the like, the rod comprising an extruded material with a uniform cross-section throughout its length and comprising an upper rod support portion which defines a groove adapted to receive rod supporting structure and a lower portion which comprises a vertical part connected to said upper portion and a flange connected to and extending horizontally from both sides of said vertical part which is adapted to receive along its upper surface movable supporting members for curtains or the like, a channel along the underside of said flange, the rod being so constructed and arranged that it is adapted to be inverted whereby said channel is adapted to receive rod supporting structure and said groove is adapted to receive movable supporting members for curtains or the like.

10. A traverse rod in accordance with claim 9 wherein said groove is of a cruciform configuration.

11. A traverse rod in accordance with claim 9 wherein said lower portion is of an inverted "T" configuration with the base of said "T" joining said upper rod support portion.

12. A traverse rod in accordance with claim 9 wherein said groove is of a cruciform configuration and said lower portion is of a "T" configuration with the base of said "T" joining said upper rod support portion.

13. A traverse rod in accordance with claim 9 wherein the rod is composed of aluminum.

14. A traverse rod in accordance with claim 9 wherein the rod is symmetrical about a vertical plane containing the rod's longitudinal axis.

15. A traverse rod for supporting curtains and the like which comprises an upper rod support portion which defines a cruciform-shaped groove and a lower portion which includes a vertical part connected centrally to said lower portion and a horizontal flange extending outwardly from both sides of said vertical part, said rod being symmetrically disposed on either side of a vertically disposed plane parallel to its length and having a substantially uniform cross section within a further vertical plane perpendicular to the first mentioned plane, said vertical part containing said first mentioned vertically disposed plane, supporting means provided on said flange whereby the rod may be inverted and supported by overhead structure through said supporting means, said groove then adapted to receive therein movable curtain suspension carriers.

16. A traverse rod for supporting curtains and the like in combination with supporting structure, the rod comprising an upper rod support portion which defines a cruciform shaped groove with crossed horizontal and vertically disposed spaces and a lower portion which comprises a vertical part connected centrally to said lower portion and a horizontal flange which extends outwardly from both sides of said vertical part, said rod being symmetrically disposed on either side of a vertically disposed plane parallel to its length and having a substantially uniform cross section within a further vertical plane perpendicular to the first mentioned vertical plane, said supporting structure adapted to be received in said groove and including a horizontally extending portion adapted to be received in said horizontal space and a vertically extending portion adapted to be received in the lower aspects of said vertical space, said vertical part being contained in said first mentioned vertical plane, support means provided on said flange whereby the rod may be inverted and supported by overhead structure through said supporting means, said groove then adapted to receive therein movable curtain suspension carriers.

* * * * *